US010281179B1

(12) United States Patent
Prezioso

(10) Patent No.: US 10,281,179 B1
(45) Date of Patent: May 7, 2019

(54) REPLACEMENT COMPRESSOR ASSEMBLY FOR AN AIR CONDITIONING SYSTEM AND METHOD

(71) Applicant: David John Prezioso, Marietta, GA (US)

(72) Inventor: David John Prezioso, Marietta, GA (US)

( * ) Notice: Subject to any disclaimer, the term of this patent is extended or adjusted under 35 U.S.C. 154(b) by 125 days.

(21) Appl. No.: 15/618,883

(22) Filed: Jun. 9, 2017

Related U.S. Application Data

(60) Provisional application No. 62/482,931, filed on Apr. 7, 2017.

(51) Int. Cl.
*F25B 27/00* (2006.01)
*F25B 41/04* (2006.01)
*F25B 45/00* (2006.01)

(52) U.S. Cl.
CPC ..... *F25B 27/00* (2013.01); *F25B 41/043* (2013.01); *F25B 45/00* (2013.01); *F25B 2327/001* (2013.01); *F25B 2500/05* (2013.01); *F25B 2600/11* (2013.01); *F25B 2700/02* (2013.01)

(58) Field of Classification Search
CPC ..... F25B 27/00; F25B 41/03; F25B 41/043; F25B 6/02
See application file for complete search history.

(56) References Cited

U.S. PATENT DOCUMENTS 3,545,219 A * 12/1970 Falk ..... F25B 13/00 62/160
4,552,240 A * 11/1985 Takeshima ..... B62D 6/02 180/422
9,417,005 B1 * 8/2016 Roth ..... F25D 17/06
2002/0157414 A1 * 10/2002 Iwanami ..... B60H 1/00778 62/239
2003/0233840 A1 * 12/2003 Choi ..... B60H 1/3222 62/236
2005/0016193 A1 * 1/2005 Tarasinski ..... B60H 1/3201 62/238.3
2005/0044873 A1 * 3/2005 Tamai ..... B60H 1/004 62/323.1
2005/0257545 A1 * 11/2005 Ziehr ..... B60H 1/004 62/236
2005/0257926 A1 * 11/2005 Turner ..... B60H 1/3222 165/202
2006/0042285 A1 * 3/2006 Heberle ..... B60H 1/322 62/236
2009/0013705 A1 * 1/2009 Nishikawa ..... B60H 1/00 62/239

(Continued)

*Primary Examiner* — Kun Kai Ma
(74) *Attorney, Agent, or Firm* — Ted Masters

(57) ABSTRACT

A replacement compressor assembly connects to an existing air conditioning system which has an electric compressor and a refrigerant line which contains a refrigerant. The replacement compressor assembly includes a compressor which is connected to a gas-powered engine. The compressor is connected to the refrigerant line so that the refrigerant passes through the compressor. A refrigerant valve is connected to the refrigerant line of the air conditioning system. The refrigerant valve is positionable to allow the refrigerant to pass through either the compressor or the electric compressor. An engine speed selector is connected to the gas-powered engine, and causes the gas-powered engine to run at a desired operating speed.

15 Claims, 8 Drawing Sheets

(56) References Cited

U.S. PATENT DOCUMENTS

| | | | | |
|---|---|---|---|---|
| 2013/0298883 | A1* | 11/2013 | Archer | B60H 1/00271<br>123/568.12 |
| 2017/0136848 | A1* | 5/2017 | Trutnovsky | B60H 1/00864 |

* cited by examiner

AIR CONDITIONING SYSTEM
500
ELECTRIC COMPRESSOR
502
CONDENSER
504
EVAPORATOR
506
AIR CONDITIONED SPACE
508
510
THERMOSTAT
516
REDUCE OPER. SPEED
FAN
512
HUMIDITY SENSOR, 34
RH
RELACEMENT COMPRESSOR ASSEMBLY
20
V1
V2
COMPRESSOR
22
REFRIGERANT VALVE, 28
CALL FOR COOLING
SWITCH TO ELECT. COMPR.
CONTROLLER
TD1 TD2
32
ENGAGE CLUTCH
START ENGINE
CLUTCH
26
GAS-POWERED ENGINE
24
ENGINE SPEED SELECTOR
30
TACHOMETER

AIR CONDITIONING SYSTEM
500
ELECTRIC COMPRESSOR
502
CONDENSER
504
EVAPORATOR
506
AIR CONDITIONED SPACE
508
510
THERMOSTAT
516
REDUCE OPER. SPEED
FAN
512
HUMIDITY SENSOR, 34
RH
RELACEMENT COMPRESSOR ASSEMBLY
20
COMPRESSOR
22
CLUTCH
26
GAS-POWERED ENGINE
24
ENGINE SPEED SELECTOR
30
CALL FOR COOLING
ENGAGE CLUTCH
START ENGINE
TACHOMETER
TD1 TD2
CONTROLLER
32

500
516
TSTAT
506
34
EOUT
EVAP
CONT. BD
504
CIN
COND.
502
ELEC. COMP.
EOUT
EOIN
CR1A2
CR1A1
CR1-1
CR1-2
CR1
CRIA
220VAC FROM BLD.
LOW VOLT.
510
ACTIVATE ELEC. COMP.
TO FAN
CALL FOR COOLING
RLY2
REFRIGERANT VALVE, 28
V1
V2
A
B
C
24
RADIATOR
BATTERY
GAS-POWERED ENGINE
CLUTCH, 26
COMPRESSOR
22
30
ENG. SPEED
32
MICRO.
START ENGINE
TACHOMETER
ENGAGE CLUTCH
20

REPLACEMENT COMPRESSOR ASSEMBLY FOR AN AIR CONDITIONING SYSTEM AND METHOD

CROSS REFERENCE TO RELATED APPLICATION

This application claims the filing benefit under 35 U.S.C. § 119(e) of U.S. Provisional Application No. 62/482,931, filed Apr. 7, 2017, which is hereby incorporated by reference.

TECHNICAL FIELD

The present invention pertains generally to air conditioning systems, and more particularly to a replacement compressor assembly which as added to an existing air conditioning for the purpose of reducing the cost of operation.

BACKGROUND OF THE INVENTION

The reduction of air conditioning energy bills would be a benefit to industrial, commercial, and residential consumers alike. Air conditioners are the largest user of electricity on buildings and homes, and accounting for approximately 48% of total electricity use. While there are advances in technology for energy efficiency and renewable energy products, most are not cost effective or easy to install and maintain. A practical solution to lowering the energy required to operate air conditioning systems would have a positive impact on utility companies, the environment, and the consumer.

BRIEF SUMMARY OF THE INVENTION

The present invention is directed to a replacement compressor assembly which is added to an existing air conditioning system. The replacement compressor assembly uses natural gas, liquid propane, or biogas to produce cooling vs. the electric-powered compressor of the existing system. The replacement compressor assembly can be retrofitted on all industrial, commercial, and residential HVAC units to replace the existing electrical compressor thereby removing 3.4 kW of electric load per ton of air conditioning from a building. The replacement compressor assembly is a simple retrofit which replaces the air conditioning system's existing electrical compressor with a gas-powered compressor while retaining the other components of the existing air conditioning system. It comprises a standalone box that sits outside the building next to an existing air conditioner. It will seamlessly integrate into commercial rooftop package HVAC units or next to the condenser compressor unit on split systems.

Moreover, the replacement compressor assembly is scalable. That is, the replacement compressor assembly has not just a single cooling capacity, but rather can be configured to provide a wide range of cooling capacity from 2 tons up to 8 tons making it a one size fits all low cost solution for air condition retrofits. Further, the replacement compressor assembly can also be used to retrofit walk-in coolers and walk-in freezers with out the use of the energy intensive electric motor driven compressors used today.

The present invention has the following advantages over the prior art:

1. The replacement compressor assembly provides a low cost affordable alternative to air conditioning and heating. This will enable home and commercial building owners to take advantage of a surplus supply of low cost natural gas and L.P. fuel currently available across the US and are projected to stay low for the next 10 years.

2 The replacement compressor assembly reduces the load on the building electric system. A.H.R.I. and the D.O.E. state that typical HVAC units currently comprise 48% of a buildings electric load. Converting to a gas-powered compressor will eliminate 40% of that load. Using natural gas will reduce the cost of cooling as the number of therms required to run the replacement compressor assembly is approximately 70% less than the cost of electricity to run the existing electric compressor.

3. The replacement compressor assembly can also provide alternative methods for peak shaving. The gas engine powered compressor can be scheduled to operate during the utility peak periods (higher cost of electricity) and reverting back to the old electric compressor during off peak periods (lower cost of electricity). This alternative method serves two functions:
   1) It only uses the gas-powered engine a few hours a day or during summer peak months, extending the intervals between engine service periods.
   2) This method allows building owners to participate in their Utility Demand side Management programs which usually pay the building owner a monthly fee to have the option to call them to reduce their electric energy consumption during periods of high-energy use. It also provides a means for the building owner to negotiate a lower cost per kWh resulting in more savings.
4. The replacement compressor assembly reduces the electric demand (kW) cost as well as the kWh which are passed on to the consumer due to electric compressor operation during the highest 15 minute or 30 minute interval of a utility billing month. This utility billing interval is exacerbated by the use of electric compressors used for air conditioning and preservation of perishable goods in both summer peak and winter months.
5. The replacement compressor assembly provides a financial benefit to public utilities. The present invention can reduce a utilities infrastructure cost to serve its consumers. A typical 5 ton HVAC unit electric compressor uses 17 kW of electricity (approximately 3.4 kW per ton) and another 1-2 kW to operate the fan in the HVAC unit. Integrating the replacement compressor assembly into existing HVAC systems will only require the existing fan to be powered with electricity. Utility companies with constrained feeders and substations typically spend on average $2M in rural areas and $5M in metropolitan areas to do re-conductor upgrades to transmission and distribution lines. The 17 kW reduction (typical 5 ton HVAC) in energy times 100 compressors (HVAC units) would reduce the load on the constrained feeder by more than 1.5 MW taking them back to a safe operating level and avoiding costly feeder upgrades. The estimated cost of converting 100 compressors to replacement compressor assembly technology would cost approximately $600,000.00, which would be a substantial savings to the utility and their clients.
6. The replacement compressor assembly provides and advantage to the environment. The replacement compressor assembly units will reduce emission over central gas fired generation and coal generation by 50%. This is due to using clean alternative fuels only when there is a demand and burning fuel at the source vs. burning large amounts of fuel to overcome losses in central power plant generation, transmission, distribution line losses and transformer losses in the existing grid infrastructure. Engines that the replacement compressor assembly utilizes meet all EPA requirements for engines less than 50 HP and require no environmental permitting.

7. The replacement compressor assembly enables renewable energy products such as solar and wind to be more effective. By removing 40% of the building electric load and adding rooftop solar or wind to the building, the solar footprint is now able to address the remaining building ancillary electric load during solar production periods. The same benefit is applicable to local wind energy production.
8. The replacement compressor assembly is market ready. Commercially available components make it possible to sell and distributor the replacement compressor assembly throughout the U.S. using existing HVAC contractors that are already skilled in the installation and maintenance of HVAC units. This will provide an immediate relief to electric grid congestion and advance renewable energy market impact.
9. The replacement compressor assembly provides cooling system redundancy. If a replacement compressor assembly would have a maintenance outage, the old electric compressor would be automatically engaged back into the cooling circuit and cooling would be provided until the corrective action is taken and the replacement compressor assembly is re-deployed.

In accordance with an embodiment an air conditioning system has an electric compressor and a refrigerant line which contains a refrigerant. A replacement compressor assembly is added to the air conditioning system. The replacement compressor assembly includes a gas-powered engine which is rotatably connected to a compressor. The compressor connects to the refrigerant line of the air conditioning system so that the refrigerant passes through the compressor.

In accordance with another embodiment, the gas-powered engine has a range of operating speeds. An engine speed selector is connected to the gas-powered engine, the engine speed selector includes a selected value of electrical resistance. The engine speed selector causes the gas-powered engine to operate at a selected operating speed within the range of operating speeds.

In accordance with another embodiment, the engine speed selector includes a DIP switch which contains a plurality of selectable electrical resistors.

In accordance with another embodiment, a refrigerant valve is connected to the refrigerant line of the air conditioning system. The refrigerant valve has positions which allow (1) the refrigerant to pass through the compressor, or (2) the refrigerant to pass through the electric compressor.

In accordance with another embodiment, the air conditioning system provides a CALL FOR COOLING signal. A controller receives the CALL FOR COOLING signal from the air conditioning system and sends a START ENGINE signal to the gas-powered engine.

In accordance with another embodiment, the gas-powered engine includes a tachometer which sends a TACHOMETER signal to the controller when the gas-powered engine is operating. If the TACHOMETER signal is not sent to the controller within a period of time after the START ENGINE signal, the controller sends a SWITCH TO ELECTRIC COMPRESSOR signal to the refrigerant valve which causes the refrigerant valve to change positions and the refrigerant to pass though the electric compressor.

In accordance with another embodiment, a clutch is connected between the compressor and the gas-powered engine. The controller receives the CALL FOR COOLING signal from the air conditioning system, and (1) sends a START ENGINE signal to the gas-powered engine, (2) implements a first time delay and after the first time delay enables the engine speed selector, and (3) implements a second time delay and after the second time delay sends an ENGAGE CLUTCH signal to the clutch.

In accordance with another embodiment, the air conditioning system has a return air duct containing air having a humidity, and a fan which has a plurality of operating speeds. A humidity sensor is positionable in the return air duct of the air conditioning system. The humidity sensor measures the humidity of the air in the return air duct and sends that humidity measurement to the controller. If the humidity of the air in the return air duct exceeds a predetermined value, the controller sends the fan a REDUCE OPERATING SPEED signal.

In accordance with another embodiment, the compressor, the gas-powered engine, the refrigerant valve, and the engine speed selector are all disposed in a housing.

Other embodiments, in addition to the embodiments enumerated above, will become apparent from the following detailed description, taken in conjunction with the accompanying drawings, which illustrate, by way of example, the principles of the replacement compressor assembly for an air conditioning system and method.

DETAILED DESCRIPTION OF THE INVENTION

Figure 1:
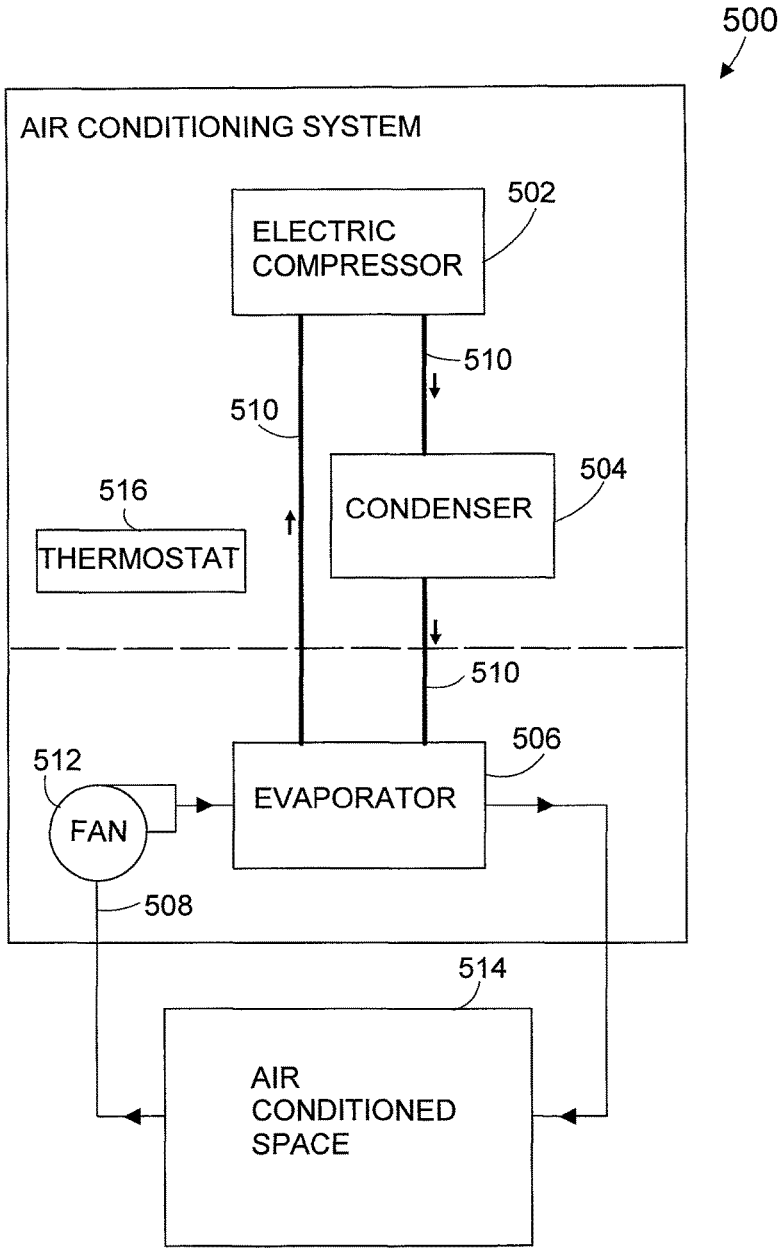
FIG. 1 PRIOR ART
FIG. 1 is a block diagram of a prior art air conditioning system.

Referring initially to FIG. 1 there is illustrated a block diagram of a prior art air conditioning system, generally designated as 500. Air conditioning system 500 includes an electric compressor 502 (a compressor powered by an electric motor), a condenser 504, and an evaporator 506. Electric compressor 502, condenser 504, and evaporator 506 are connected by a refrigerant line 510 such as of copper tubing (shown in bold) which contains a refrigerant (e.g. R-410A, R-22, etc.). The refrigerant in refrigerant line 510 circulates between the electric compressor 502, condenser 504, and evaporator 506 to effect cooling in the manner well known in the art. A fan (blower) 512 blows air across the cooled evaporator 506 into an air conditioned space 514 such as the rooms of a building. Fan 512 receives air from a return air duct 508. The desired temperature of air conditioned space 514 is controlled by a thermostat 516 which provides a call for cooling when the temperature is above a set level. Air conditioning system 500 can be a split system in which evaporator 506 and fan 512 are located within the building (shown by a broken line in the figure), or a package unit in which all components are located outside of the building.

Figure 2:
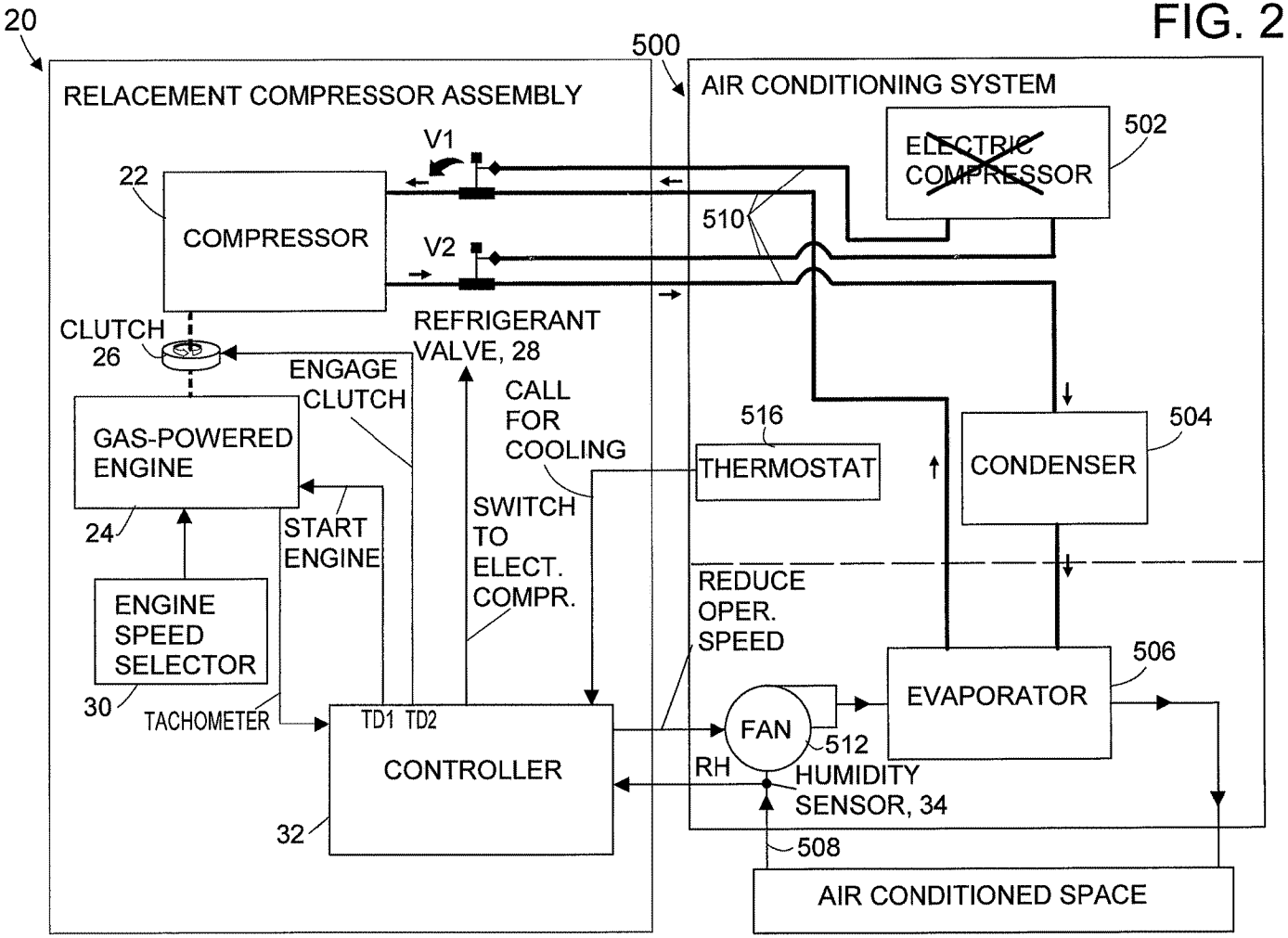
FIG. 2 is a block diagram of the prior art air conditioning system and a replacement compressor assembly in accordance with the present invention in a first mode of operation.

FIG. 2 is a block diagram of prior art air conditioning system 500 and a replacement compressor assembly 20 in accordance with the present invention in a first mode of operation. Replacement compressor assembly 20 includes a compressor 22 which is connected to a gas-powered engine 24. Gas-powered engine 24 operates on natural gas, propane, biogas, or any other gas suitable for running an internal combustion engine. Gas-powered engine 24 provides the power to turn compressor 22 in the same manner that an electric motor turns electric compressor 502 of air conditioning system 500. A mechanical clutch 26 is connected between compressor 22 and gas-powered engine 24. When clutch 26 is engaged, the rotation of gas-powered engine 24 is coupled to compressor 22 to turn the compressor. In an embodiment, clutch 26 is a magnetic clutch.

Compressor 22 is configured to connect to the refrigerant line 510 of air conditioning system 500 so that the refrigerant passes through compressor 22. That is, as shown in FIG. 2, compressor 22 has been connected (by a refrigerant valve 28, see discussion below) so that it replaces the electric compressor 502 of air conditioning system 500, while other components of air conditioning system 500 remain in use. In this configuration, electric compressor 502 is de-activated as shown by the cross out. The arrows show the flow of refrigerant to and from compressor 22. It may be appreciated that if air conditioning system 502 is a heat pump system, compressor 22 will also be used for heating.

Figure 3:
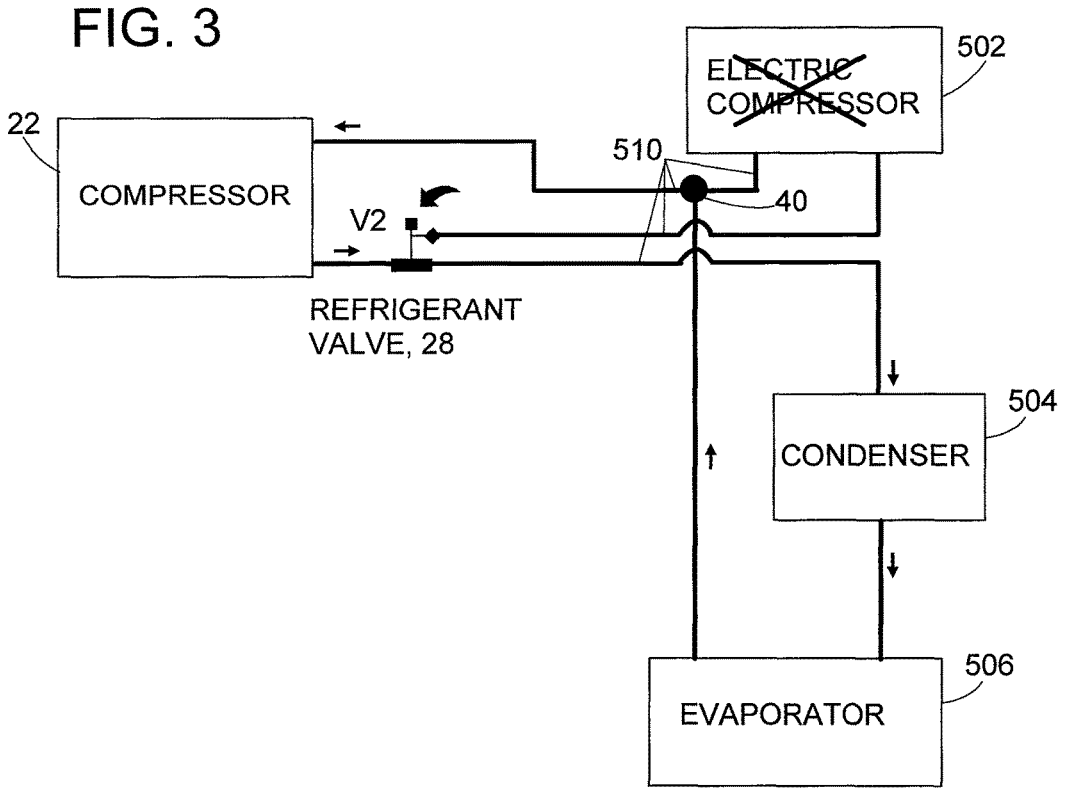
FIG. 3 is a block diagram of the prior art air conditioning system and the replacement compressor assembly having another refrigerant valve configuration.
Figure 4:
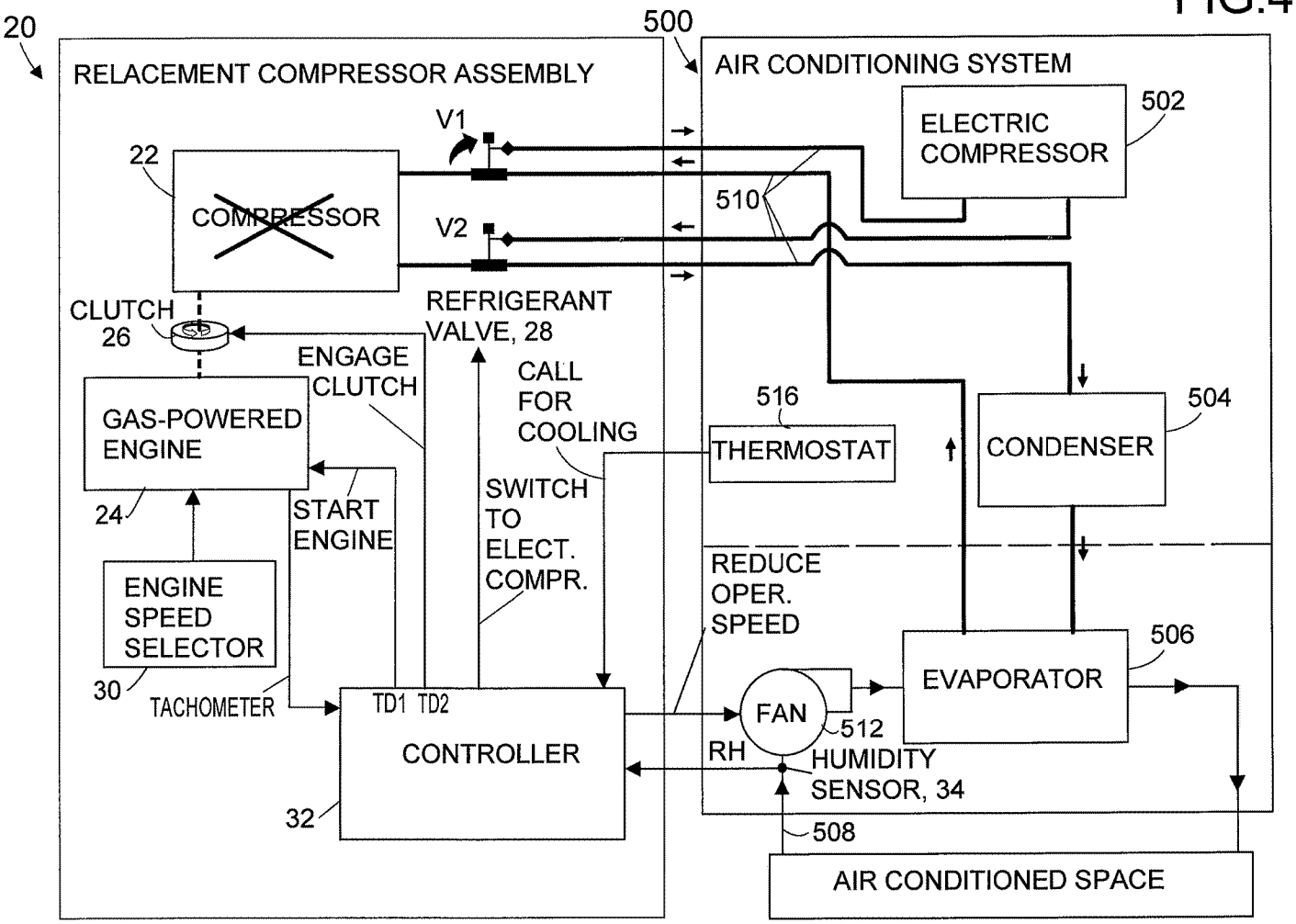
FIG. 4 is a block diagram of the prior art air conditioning system and the replacement compressor assembly in a second mode of operation.
Figure 8:
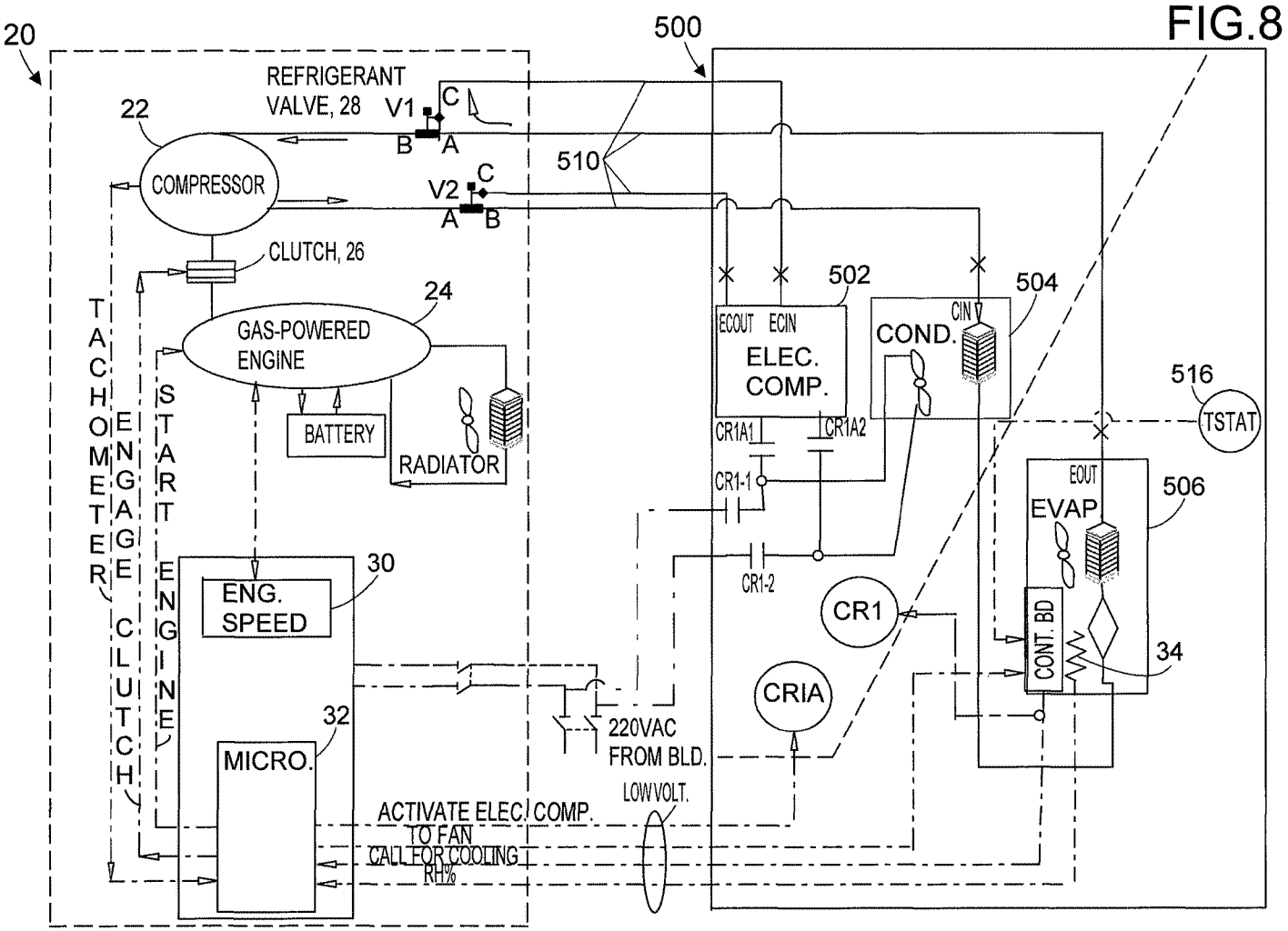
FIG. 8 is a block diagram of the prior art air conditioning system and the replacement compressor assembly showing additional features; and, FIG. 9 is a schematic diagram of a controller.

Replacement compressor assembly 20 further includes a refrigerant valve 28 which is configured to connect to the refrigerant line 510 of air conditioning system 500 (also refer to FIG. 8 and the associated discussion). Refrigerant valve 28 is positionable to either allow (1) the refrigerant to pass through compressor 22 (as shown in FIG. 2), or (2) the refrigerant to pass through the electric compressor 502 (as shown in FIG. 4). In other words, refrigerant valve 28 serves as a switch which channels the flow of refrigerant to either compressor 22 or to electric compressor 502. In FIG. 2, refrigerant valve 28 has been positioned so that the refrigerant flows through compressor 22. In the shown embodiment refrigerant valve 28 includes two three way two position solenoid valves V1 and V2. V1 routes the suction side of the refrigerant line 510 coming from evaporator 506 to either compressor 22 (FIG. 2) or to electric compressor 502 (FIG. 4), and V2 routes the high pressure side of either compressor 22 (FIG. 2) or electric compressor 502 (FIG. 4) to condenser 504. However, it may be appreciated that other refrigerant valve 28 configurations are also possible, any of which selectively route the refrigerant to either compressor 22 or to electric compressor 502. For example, both the suction and high pressure sides could be switched with a single six port valve. Another refrigerant valve 28 configuration is shown in FIG. 3. In this configuration the suction sides of refrigerant line 510 at electric compressor 502 and compressor 22 are simply connected together at 40 (black dot) and to evaporator 506. As such, valve V1 of FIG. 2 is eliminated, and refrigerant valve 28 only consists of valve V2 which switches the high pressure sides of the compressor. It may be appreciated that in yet another refrigerant valve 28 configuration, V2 could be eliminated, high pressure sides of of compressor 22 and electric compressor 502 could be connected together and to condenser 504, and valve V1 would switch the suction sides of refrigerant line 510. In view of the above, as used herein the term "refrigerant valve" embraces any valve configuration which can be used to route the refrigerant to either compressor 22 or electric compressor 502 so that the selected compressor is used to operate the system.

Gas-powered engine 24 has a range of operating speeds. For example, gas-powered engine 24 could operate in a range from 1000 rpm to 2750 rpm. An engine speed selector 30 is connected to gas-powered engine 24. Engine speed selector 30 is configured to cause gas-powered engine 24 to operate at a selected operating speed (e.g. 2000 rpm) within the range of operating speeds. That is, the operating speed of gas-powered engine 24 is controlled by engine speed selector 30. Higher engine speeds cause compressor 22 to turn faster and produce more cooling, whereas lower engine speeds cause compressor 22 to turn slower and produce less cooling. In this manner the engine speed of the air conditioning system 500/replacement compressor assembly 20 combination can be changed to accommodate different installations (e.g. from 2 tons to 8 tons). In the shown embodiment, engine speed selector 30 includes a selected value of electrical resistance.

Figure 7:
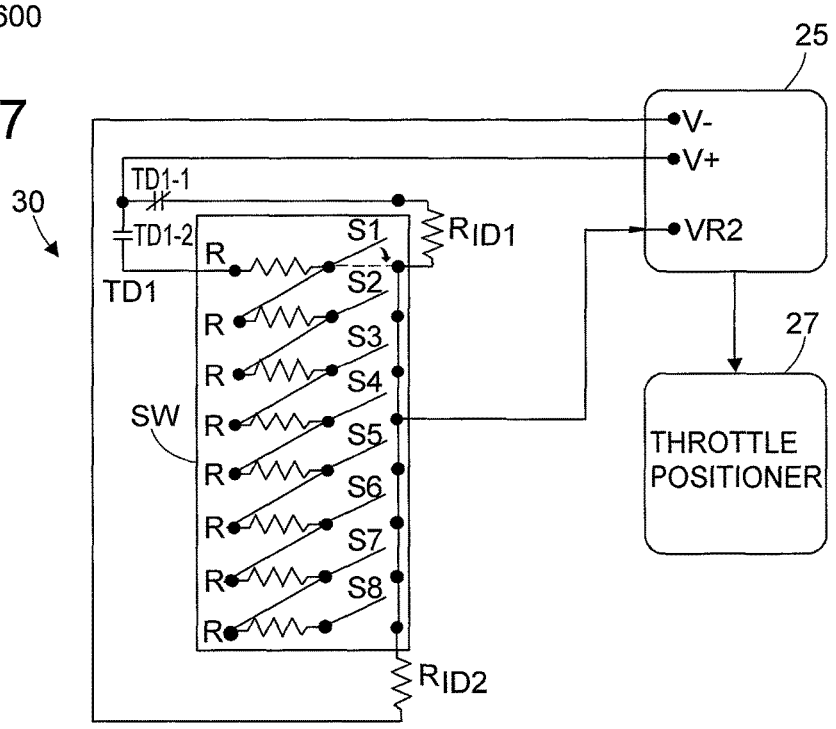
FIG. 7 is a schematic diagram of a engine speed selector.

In the shown embodiment, gas-powered engine 24 includes an embedded engine speed control feature. As is known in the art, this feature allows the user to connect a resistor to the engine, wherein the value of electrical resistance of the resistor sets a voltage which determines the speed at which the engine runs by controlling the mechanical throttle of the engine. The engine speed will be matched to the appropriate air conditioning capacity output required of compressor 22. FIG. 7 shows a schematic diagram of an engine speed selector 30 which provides a value of electrical resistance. It may be appreciated however that other forms of speed selector 30 could be utilized. For example, speed selector 30 could comprise mechanical components such as a throttle valve which control the speed of the engine without using values of electrical resistance.

Figure 9:
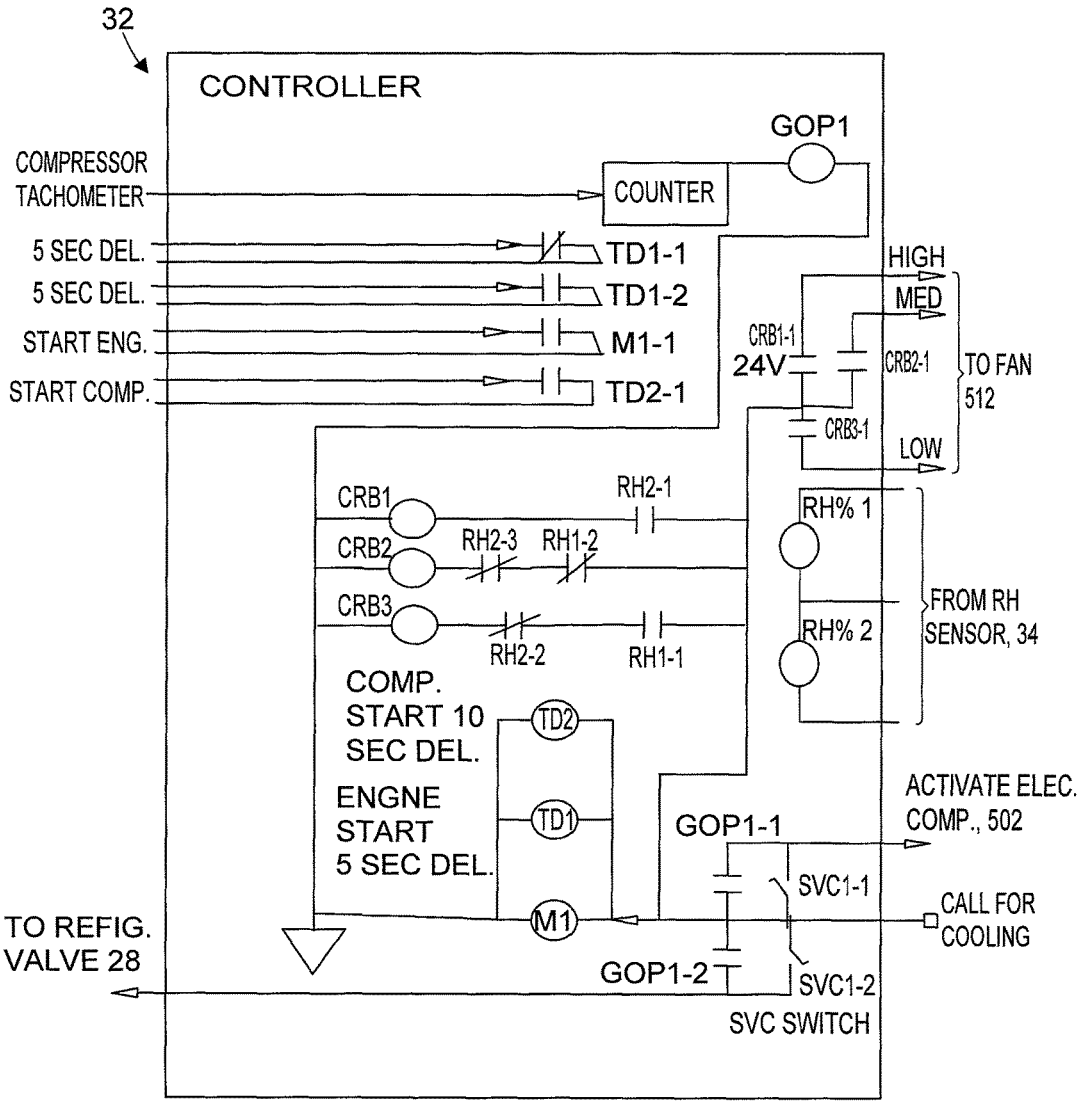

In the shown embodiment, a controller 32 is used to implement switching and control functions of replacement compressor assembly 20 (also refer to FIG. 9 and the associated discussion). For example, compressor 22 is activated through a sequence of events. Air conditioning system 500 provides a CALL FOR COOLING signal such as from thermostat 516. Controller 32 is configured to receive the CALL FOR COOLING signal from air conditioning system 500 and (1) send a START ENGINE signal to gas-powered engine 24, (2) implement a first time delay TD1 (e.g. 5 seconds) and after the first time delay enable the engine speed selector 30, and (3) implement a second time delay TD2 (e.g. 10 seconds) and after the second time delay send an ENGAGE CLUTCH signal to clutch 26. In an embodiment, items (1) through (3) are implemented through switch closures in controller 32.

Gas-powered engine 24 includes a tachometer which is configured to send a TACHOMETER signal to controller 32 when gas-powered engine 24 is operating. If the TACHOMETER signal is not sent to controller 32 within a period of time T (e.g. 30 seconds) after the START ENGINE signal, controller 32 is configured to send a SWITCH TO ELECTRIC COMPRESSOR signal to refrigerant valve 28 which causes refrigerant valve 28 to change positions and to pass the refrigerant though the electric compressor 502 That is, electric compressor 502 serves as a backup in the event compressor 22 in non-operational.

In another embodiment, fan 512 has a plurality of operating speeds (e.g. high, medium, and low). Air conditioning system 500 has a return air duct 508 containing air which has a humidity. A relative humidity sensor 34 is positioned in the return air duct 508 of the air conditioning system 500. Humidity sensor 34 is configured to measure the humidity RH of the air in the return air duct 508 and send that humidity measurement to controller 32. If the humidity RH of the air in the return air duct 508 exceeds a predetermined value (e.g. 50%), controller 32 is configured to send a REDUCE OPERATING SPEED signal to the fan 512.

FIG. 4 is a block diagram of the prior art air conditioning system 500 and replacement compressor assembly 20 in a second mode of operation. In this mode refrigerant valve 28 has been positioned so that the refrigerant flows through electric compressor 502. As in FIG. 2, the arrows indicate refrigerant flow. This is a backup mode which can provide cooling when compressor 22 is off-line for maintenance or other reasons. In effect air conditioning system 500 operates as it did before the introduction of replacement compressor assembly 20. It may be appreciated that this mode also requires the rerouting of certain electrical signals, some of which are provided by controller 32. Also, it is noted that in this mode while signal paths within replacement compressor assembly 20 are still shown, they are inactive since compressor 22 is not being utilized.

Figure 5:
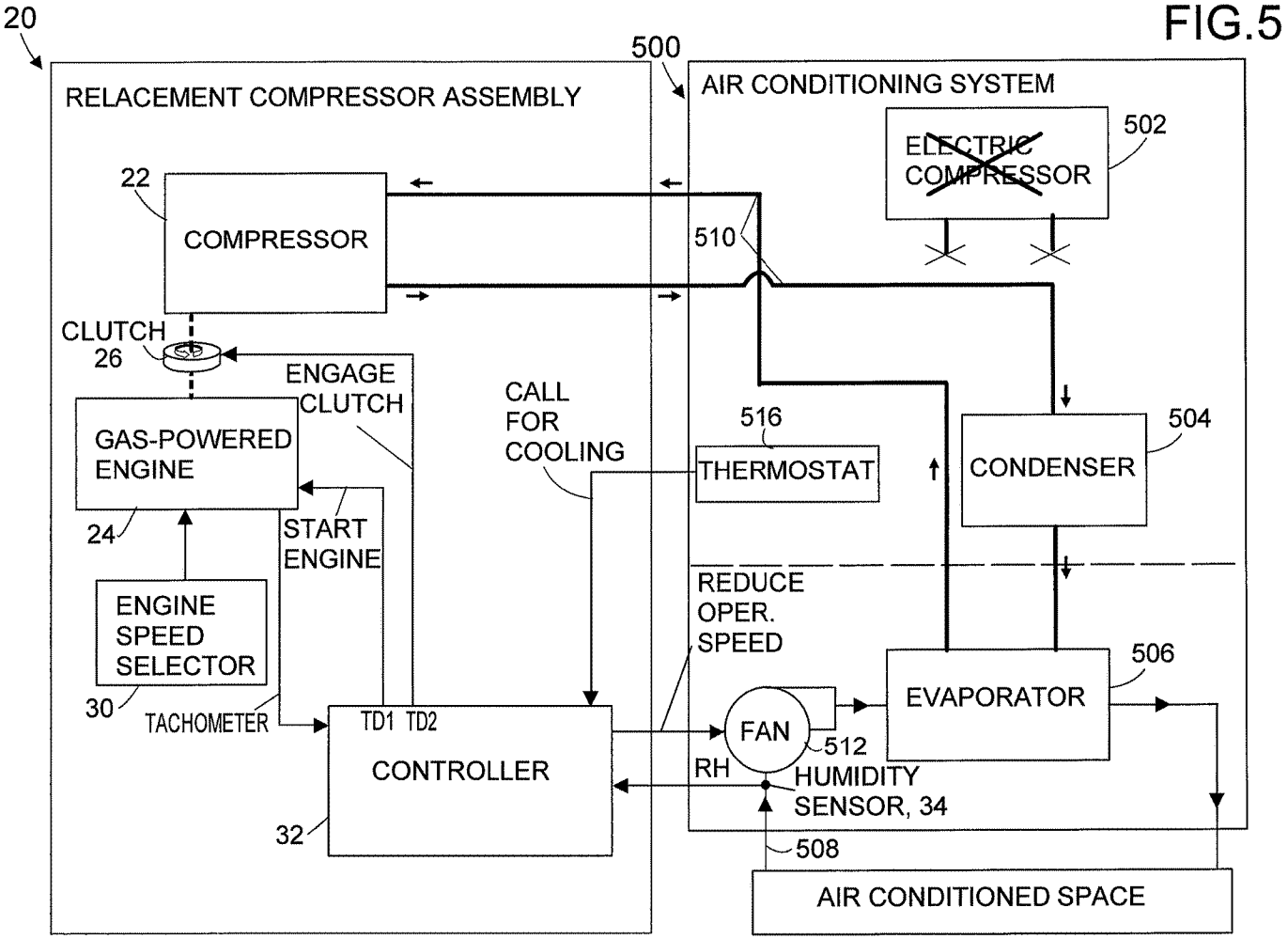
FIG. 5 is a block diagram of the prior art air conditioning system and the replacement compressor assembly showing a different refrigerant line connection.

FIG. 5 is a block diagram of the prior art air conditioning system 500 and the replacement compressor assembly 20 showing a different refrigerant line connection. This embodiment is a simplified version of the embodiment of FIG. 2. In this embodiment replacement compressor assembly 20 does not have a refrigerant valve 28. Rather, the refrigerant lines 510 to electric compressor 502 are disconnected and electrical compressor 502 is permanently deactivated and cannot serve as a backup. The refrigerant lines 510 are rerouted to compressor 22. Otherwise operation is similar to that of FIG. 2. It is noted that the SWITCH TO ELECTRIC COMPRESSOR signal between controller 32 and refrigerant valve 28 (refer to FIG. 2) is not shown since it no longer applies.

Figure 6:
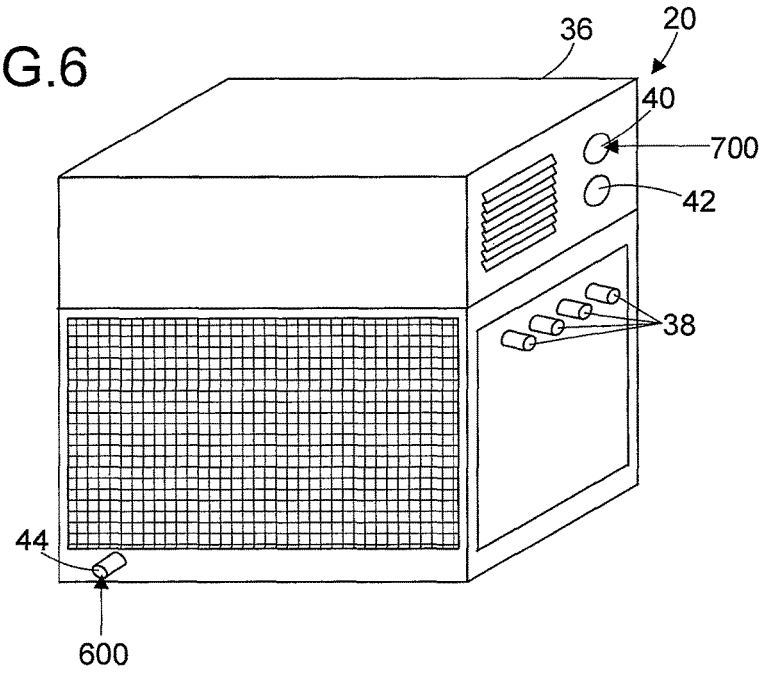
FIG. 6. is a perspective view of the replacement compressor assembly.

FIG. 6. is a perspective view of replacement compressor assembly 20. Also referring to FIG. 2, replacement compressor assembly 20 is packaged in a housing 36 which is located outside a building adjacent to air conditioning system 500. In an embodiment housing 36 is approximately 2' by 2' by 2'. Shown are the connections 38 for refrigerant line 510, a 208-230 VAC electrical power supply 700 connection 40 to the building, the connection for low voltage signal wires 42 (e.g. CALL FOR COOLING, etc.), and a gas 600 (such as natural gas) inlet 44 for operating gas-powered engine 24. It is noted that compressor 22, gas-powered engine 24, refrigerant valve 28, engine speed selector 30, controller 32, and associated components are all disposed in housing 36.

FIG. 7 is a schematic diagram of an engine speed selector 30. In this embodiment engine speed selector 30 includes a selected value of electrical resistance which is provided by a DIP switch SW. DIP switch SW contains a plurality of selectable electrical resistors. Gas-powered engine 24 includes an embedded speed control 25, which includes three electrical poles, V+, V−, and VR2. Embedded speed control 25 sends a signal to a throttle positioner 27 which mechanically changes the position of the throttle of gas-powered engine 24. The V+ and V− poles are connected to opposite ends of DIP switch SW, and the VR2 pole is connected to the resistive output of DIP switch SW. A voltage exists between V+ and V−. In the shown embodiment DIP switch SW has eight selectable switches S1-88, eight associated selectable values of electrical resistance R (e.g. 1100 ohms each configured in series), and a time delay TD1 (from controller 32, also refer to FIG. 9). It is noted that the time delay TD1 is implemented in controller 32. DIP switch SW is connected to two idle resistors $R_{ID1}$ and $R_{ID2}$. The two idle resistors provide a voltage divider which determines the voltage at VR2. The values of the two idle resistors are selected so as to cause gas-powered engine 30 to idle at a desired speed, and will vary as a function of the particular engine and embedded speed control design. In the shown embodiment, $R_{ID1}$ is 250 ohms and $R_{ID2}$ is 1000 ohms. Similarly the value of R will depend upon the particular engine and embedded speed control design.

Also referring to Table 1, which one of selectable switches S1-S8 is closed determines the value of electrical resistance across V+ and VR2, and therefore the RPM speed of gas-powered engine 24, and the RPM speed of compressor 22. In the shown embodiment gas-powered engine 24 is mechanically coupled at a 1:1 RPM ratio with compressor 22. It is noted that It is actually the value of the voltage applied to embedded speed control 25 which changes the speed of gas-powered engine 24.

The sequence of operation of engine speed selector 30 is as follows (assuming the user has set switch S1 to the closed position as shown by the dashed line and the small arrow). At the time of gas-powered engine 24 start, time delay switch TD1-1 is closed and switch TD1-2 is open. As such, the electrical resistance between V+ and VR2 is the idle resistor $R_{ID1}$ (e.g. 250 ohms). This causes gas-powered engine 22 to initially operate at an idle speed. Then after 5 seconds, time delay switch TDI-1 opens and time delay switch TD1-2 closes so that the electrical resistance between V+ and VR2 is R (e.g. 1100 ohms). Referring to Table 1, this causes the operating speed of gas-powered engine 24 and compressor 22 to be 1000 rpm, and the cooling capacity to be 2.73 tons. Similarly, if switch S4 were set to the closed position, the idle operation would be the same, however after TD1-1 opens and TD1-2 closes the electrical resistance between V+ and VR2 would be R+ R+R+R (e.g. 4400 ohms), the operating speed of gas-powered engine 24 and compressor 22 would be 1750 RPM, and the cooling capacity would be 5.07 tons. It is noted in the shown embodiment that the speed of gas-powered engine 24 is proportional to the value of electrical resistance. Also, it may be appreciated that specific component values and settings will vary depending upon gas-powered engine 24 type. Table 1 is only an example of values for one engine and compressor combinations. Variations will occur when using different gas-powered engines 24 and compressors 22.

TABLE 1

| SWITCH SETTING | COOLING CAPACITY (TONS) | SPEED OF COMPRESSOR/ ENGINE (RPM) | ELECTRICAL RESISTANCE (OHMS) |
|---|---|---|---|
| S1 | 2.73 | 1000 | 1100 |
| S2 | 3.49 | 1250 | 2200 |
| S3 | 4.28 | 1500 | 3300 |
| S4 | 5.07 | 1750 | 4400 |
| S5 | 5.86 | 2000 | 5500 |
| S6 | 6.62 | 2250 | 6600 |
| S7 | 7.38 | 2500 | 7700 |
| S8 | 8.16 | 2750 | 8800 |

It may be appreciated that engine speed selector 30 can take other forms such as (1) a variable resistor (potentiometer) which is connected between V+ and VR2, (2) a fixed resistor connected between V+ and VR2, and (3) an electrical voltage which is applied at VR2.

FIG. 8 is a block diagram of the prior art air conditioning system 500 and the replacement compressor assembly 20 showing additional features, and FIG. 9 is a schematic diagram of controller 32. Also referring to FIG. 2, there is a CALL FOR COOLING signal from the furnace control board (such as from a thermostat 516) of air conditioning system 500. This activates coil M1 and closes M1-1 contactor to start gas-powered engine 24 of the replacement compressor assembly 20. The CALL FOR COOLING also activates the time delay (TD1) (e.g. 5 seconds), which holds engine speed selector 30 (refer to FIG. 7) in start/idle mode through the normally closed contactor TD1-1 and the normally open contactor TD!-2. This allows gas-powered engine 24 to get up to idle speed. Once the 5 seconds times out TD1-1 opens and TD1-2 closes which places the engine speed selector 30 in operation (refer to FIG. 7 and the associated discussion). Gas-powered engine 24 will ramp up to the cooling capacity set by engine speed selector 30. The cooling capacity is set by the installer to match the capacity of the old compressor (502).

The CALL FOR COOLING also activates the time delay TD2 (e.g. 10 seconds) starting it's 10 second delay which, when timed out, will activate clutch 26 (ENGAGE CLUTCH) to initiate compressor 22 run. This allows compressor 22 to operate at the selected capacity set by the engine speed selector 30.

Compressor 22 provides a TACHOMETER signal to a software register labeled counter to monitor the RPM of compressor 22. This allows a technician to compare the actual compressor speed with that set by engine speed selector 30 to ensure compressor capacity is met. The counter register also activates the Gop1 coil, which keeps the contactor Gop1-1 open making compressor 22 the primary compressor via Gop1-2 by positioning refrigerant valve 28 to cause the refrigerant to flow through compressor 22. Conversely, Gop1-1 positions refrigerant valve 28 to cause refrigerant to flow through electric compressor 502. If 38 the TACHOMETER signal is not read within a period of time (e.g. 30 seconds) after a CALL FOR COOLING is made, the Gop1 coil de-energizes and closes Gop1-1 putting the back up (old) electric compressor 502 in the cooling circuit. There is also a manual service switch (SVC) in parallel with the Gop1-1 contactor to allow a service technician to place the replacement compressor assembly 20 in bypass when servicing the unit. The SVC switch has two sets of contacts both are normally open. When the service technician needs to place the replacement compressor assembly 20 in bypass for the back up (old) compressor 502 to operate, this switch sends the CALL FOR COOLING signal from air conditioning system 500 to the condenser 504 fan and old compressor 502 control relay CR as well as to the 3 way solenoid-controlled refrigerant valve 28 (V1 and V2 as shown) into bypass mode sending the refrigerant path to the compressor 502 and allowing the compressor 502 to operate as originally designed (refer to FIG. 4).

In an embodiment controller 32 is a microcontroller. However controller 32 could also be another type of computer, or the control, switching, signal generation and receipt, and time delay functions of controller 32 could be implemented by a collection of discrete electronic components (e.g. switches, relays, timers, etc.)

Referring to FIG. 8, the routing of refrigerant line 510 to replacement compressor assembly 20 will vary depending upon the configuration of refrigerant valve 28. FIG. 8 shows the same routing configuration as FIG. 2. In this configuration refrigerant line 510 was cut (denoted by an "X") and rerouted such that the line is connected between the input ECIN of electric compressor 502 and port V1C of valve V1 of refrigerant valve 28. Similarly, refrigerant line 510 is cut and rerouted such that the line is connected between the output ECOUT of electric compressor 502 and port V2C of valve V2 of refrigerant valve 28. And, refrigerant line 510 is cut and rerouted such that the line is connected between the output EOUT of evaporator 506 and port A of valve V1 of refrigerant valve 28. And, refrigerant line 510 is cut and rerouted such that the line is connected between the input CIN of condenser 504 and port B of valve V2 of refrigerant valve 28. The high pressure output side of compressor 22 is connected to port B of valve V1 of refrigerant valve 28, and the suction input side of compressor 22 is connected to port B of valve V2 of refrigerant valve 28 to complete the refrigerant path. It may be appreciated however, that other refrigerant line 510 routing configurations are also possible. For example the routing could also be as shown in FIGS. 3 and 5.

In another embodiment there are an array of coils and contactors, RH % 1 & RH % 2 (these are coils which are activated by the state of the humidity sensor switch in the duct work) which will take a signal from humidity sensor 34 to adjust the motor speed of fan 512 to match cooling plus RH % requirements of the building. The humidity sensor 34 is installed in the return air duct 512 of existing air conditioning system 500.

If there is no RH % sensor 34 installed the system operates purely off of the CALL FOR COOLING with no ECM (electronically controlled motor) speed adjustment thus using the fixed motor speed set by the air conditioning system 500. RH sensor 34 will operate the speed of fan 512 through the manipulation of CBR1/Low speed, CBR2/Medium speed and CBR3/High speed. What this does is simply reduce the fan speed if the RH % is higher than the set point of the switch to slow the humid air going through the coils to take more moisture out of the air. When the RH % is lower than the set point the fan 512 is sped up to move more air over the coil and turn cool air faster in the building space. There is a dead band of 20% in the switch so that cycling is at a minimum. The RH % 1 & RH % 2 coils are timed for a minimum time of operation (between 2-3 minutes) to avoid coil icing.

When the CALL FOR COOLING is met (the set temperature is achieved) the 24vac CALL FOR COOLING signal from the furnace control board is removed from the circuit and clutch 26 is disengaged allowing compressor 22 to stop and the engine start contactor M1-1 to open thereby turning gas-powered engine 24 off. The system is then de-energized and is ready for the next CALL FOR COOLING from the thermostat 516.

In FIG. 8, control relay CR1 has contacts CR1-1 and CR1-2 they are the original old compressor 502 control relay and contacts. When there is a call for cooling in the original HVAC unit these contactors close starting the condenser fan and the old compressor. By adding a second control relay CR1A with contacts CR1A1 and CR1A2 between the original relay contacts (CR1-2 & CR1-2) of the old compressor and the old compressor 502 it self, the controller now has the ability to block operation (voltage) to the old compressor keeping the old compressor off line while still using the old compressor relay to control the condenser fan with the new gas operated compressor 22. "To Refrigerant Valve 28" changes the state of SV1 & SV2 to change the flow of refrigerant from the gas-operated compressor 22 to the old electric compressor 502.

In FIG. 9, For Relative Humidity (RH) control a signal comes from the humidity sensor placed in the return air duct. This sensor has two outputs. In the normal operating mode, shown in the logic to coils CRB1, CRB2 & CRB3.

CRB2 is controlling the blower fan speed, which is the medium speed. This is the state when the humidity is between the set points of the humidity sensor.

An example the would be the if the humidity sensor switch is set to activate at 40% for the low and 60% for high humidity and if the humidity is between these two points (50%) CRB2 is operating the fan at medium speed mode. If the humidity goes higher than 60%, the humidity sensor energizes the coil RH % 1 closing contacts RH1-1 and opening contact RH1-2 this turns off the signal to medium speed mode of the furnace blower and turns on the low speed mode of the furnace blower by energizing CRB3 and Contact CRB3-1. This low speed mode only operates for 3 minutes, as Coil RH % 1 is a timing relay function. A timing function of relays RH % 1 and RH % 2 are in the controller. Once the time of 3 minutes has been met then the controller returns the speed to the normal state by turning back on the medium speed mode of the furnace blower. This action slows down the airflow across the evaporator coils allowing it to become colder and remove more moisture out of the air passing over it, thus reducing the humidity of the air going back to the building space. In the case of low humidity being sensed, that is 40% or lower the humidity sensor activates coil RH % 2 and closes contact RH2-1 activating coil CRB1 and closing CRB1-1 placing the furnace blower circuit in high speed mode and simultaneously opening RH2-2, RH2-3 and de-energizing the other two relays.

It may be appreciated that air conditioning system 500 and replacement compressor assembly 20 may be combined to form a modified air conditioning system.

The electrical connection of replacement compressor assembly 20 to air conditioning system 500 will depend on the voltage supplied to the original outside condenser unit of air conditioning system 500, either 208-230 VAC single phase, or 460 VAC three phase. In either case the replacement compressor assembly 20 will only require 208-230 VAC single phase power. The mechanical installation will vary depending upon the different configurations of refrigerant switching as shown in FIGS. 2, 3, and 5. That is, the cutting and rerouting of refrigerant line 510 to replacement air compressor assembly 20 will be determined by the desired refrigerant switching configuration.

In terms of use, a method for producing and operating a modified air conditioning system includes:

(a) providing a gas supply 600;
(b) providing an electrical power supply 700;
(c) providing additional refrigerant line;
(d) providing a recharging refrigerant;
(e) providing an air conditioning system 500, the air conditioning system 500 having an electric compressor 502, a condenser 504, an evaporator 506, a refrigerant line 510 which contains a refrigerant, the refrigerant line 510 (1) connecting the electric compressor 502 to the condenser 504, (2) connecting the electric compressor 502 to the evaporator 506, and (3) connecting the condenser 502 to the evaporator 506, and a thermostat 516 which produces a call for cooling signal;
(f) providing a replacement compressor assembly 20 which includes a compressor 22, a gas-powered engine 24, an engine speed selector 30, and a refrigerant valve 28;
(g) purging the refrigerant from the refrigerant line 510;
(h) after (g), cutting the refrigerant line 510 and connecting it to the refrigerant valve 28 with the additional refrigerant line;
(i) after (h), charging the refrigerant line 510 with the recharging refrigerant;
(j) connecting the gas supply 600 to the replacement compressor assembly 20;
(k) connecting the electrical power supply 700 to the replacement compressor assembly 20;
(l) positioning the refrigerant valve 28 to allow the refrigerant to pass through the compressor 22;
(m) using the engine speed selector 30 to select a desired engine speed; and,
(n) activating air conditioning system 500 and replacement compressor assembly 20, wherein the call for cooling signal is routed from air conditioning system 500 to replacement compressor assembly 20.

The method further including:

in step (m), connecting a selected value of electrical resistance to the gas-powered engine 24.

The method further including:

in step (m), the engine speed selector 30 including a DIP switch which contains a plurality of selectable electrical resistors.

The method further including:

positioning the refrigerant valve 28 to allow the refrigerant to pass through the electric compressor 502.

Note: Unless specifically otherwise stated, and as applicable, the order of performance of the above cited method steps can be changed.

By way of summary, the replacement compressor assembly has the following features and advantages:

It operates on natural gas, liquid propane, or biogas.

It replaces the electric compressor by integrating its gas-powered engine/compressor and control system into the existing HVAC system.

The gas-powered engine can be either liquid cooled or air-cooled.

In an embodiment, the replacement compressor assembly is installed in parallel ("piggyback") with the old (still operational) electric compressor. In such parallel installations, the replacement compressor assembly will be the primary compressor while the old existing electric compressor will be connected in such a way as it serves as a back up compressor to the system if the replacement compressor assembly is not operational or being serviced. That is, the replacement compressor assembly and existing electric compressor can be switched so that either one or the other provides the compressor function. The switching is accomplished by a refrigerant valve which changes the routing of the HVAC refrigerant from through the old compressor to through the compressor of the replacement compressor assembly, or visa versa.

It reduces the electric load on a building by 40% as the compressor is no longer using electric power. However about 8% of electric power will be still be used by the remaining components of the old HVAC unit to run it's fans and controls delivering the cooling to the building.

The replacement compressor assembly will work in conjunction with about 85% of the old HVAC system which is still used, and give a 20 year extended life cycle to the HVAC unit.

The replacement compressor assembly works with all gas fired, electric heat HVAC units as well as it integrates into heat pump systems.

The integrated technology allows the replacement compressor assembly unit to deliver 2 tons through 8 tons of cooling through a unique selector circuit making it a one size fits all retrofit system. For example, the same replacement compressor assembly can be used to replace a 2, 3, 4, 5, 6, 7, or 8 ton electric compressor. In one embodiment, the installer simply selects one of 8 DIP switch settings to match the capacity of the old compressor being replaced. The capacity settings control the speed of the gas-powered engine of the replacement compressor assembly. The faster the speed of the engine, the faster the compressor turns, and the more cooling capacity is provided.

A fixed resistor or potentiometer could be used to control the signal to the embedded engine speed control, which in turn changes the capacity output of the compressor.

The replacement compressor assembly has an optional humidity sensor (RH %) that can be installed in the return air duct of the existing HVAC system to measure humidity of the return air. If the humidity is is over 50% the replacement compressor assembly will modulate the air flow by reducing the blower air speed for a set period of time until the RH % is below 50%. It will then increase the blower speed to match the cooling capacity. This feature assists in avoiding coil icing.

The embodiments of the replacement compressor assembly for an air conditioning system and method described herein are exemplary and numerous modifications, combinations, variations, and rearrangements can be readily envisioned to achieve an equivalent result, all of which are intended to be embraced within the scope of the appended claims. Further, nothing in the above-provided discussions of the replacement compressor assembly for an air conditioning system and method should be construed as limiting the invention to a particular embodiment or combination of embodiments. The scope of the invention is defined by the appended claims

I claim:

1. A replacement compressor assembly for an air conditioning system, the air conditioning system having an electric compressor and a refrigerant line which contains a refrigerant, the air conditioning system is configured to provide a call for cooling signal, the replacement compressor assembly comprising:

a gas-powered engine;

a compressor which is connected to said gas-powered engine, said compressor is configured to connect to the refrigerant line of the air conditioning system so that the refrigerant passes through said compressor;

a clutch which is connected between said compressor and said gas-powered engine;

an engine speed selector which is connected to said gas-powered engine; and, a controller which is configured to receive the call for cooling signal from the air conditioning system, and (1) send a start engine signal to said gas-powered engine, (2) implement a first time delay and after said first time delay enable said engine speed selector, and (3) implement a second time delay and after said second time delay send an engage clutch signal to said clutch.

2. The replacement compressor assembly according to claim 1, further including:

said gas-powered engine having a range of operating speeds;

said engine speed selector including a selected value of electrical resistance; and, said engine speed selector is configured to cause said gas-powered engine to operate at a selected operating speed within said range of operating speeds.

3. The replacement compressor assembly according to claim 1, further including:

said engine speed selector including a DIP switch which contains a plurality of selectable electrical resistors.

4. The replacement compressor assembly according to claim 1, further including:

a refrigerant valve which is configured to connect to the refrigerant line of the air conditioning system; and, said refrigerant valve is positionable to allow (1) the refrigerant to pass through said compressor, or (2) the refrigerant to pass through the electric compressor.

5. The replacement compressor assembly according to claim 1, the air conditioning system having a return air duct containing air having a humidity, and a fan which has a plurality of operating speeds, the replacement compressor assembly further including:

a humidity sensor which is positionable in the return air duct of the air conditioning system;

said humidity sensor configured to measure the humidity of the air in the return air duct and send that humidity measurement to said controller; and, if the humidity of the air in the return air duct exceeds a predetermined value, said controller is configured to send the fan a reduce operating speed signal.

6. The replacement compressor assembly according to claim 1, further including:

a refrigerant valve which is configured to connect to the refrigerant line of the air conditioning system;

a housing, and, said compressor, said gas-powered engine, said refrigerant valve, and said engine speed selector all disposed in said housing.

7. The replacement compressor assembly according to claim 1, the replacement compressor assembly further including:

said gas-powered engine having a range of operating speeds;

said engine speed selector is configured to cause said gas-powered engine to operate at a selected operating speed within said range of operating speeds;

a refrigerant valve which is configured to connect to the refrigerant line of the air conditioning system; and, said refrigerant valve is positionable to allow (1) the refrigerant to pass through said compressor, or (2) the refrigerant to pass through the electric compressor.

8. A modified air conditioning system, comprising:

an air conditioning system having an electric compressor and a refrigerant line which contains a refrigerant;

a gas-powered engine;

a compressor which is connected to said gas-powered engine, said compressor is configured to connect to said refrigerant line of said air conditioning system so that said refrigerant passes through said compressor;

said air conditioning system is configured to provide a call for cooling signal;

a clutch which is connected between said compressor and said gas-powered engine;

an engine speed selector which is connected to said gas-powered engine; and, a controller which is configured to receive said call for cooling signal from said air conditioning system, and (1) send a start engine signal to said gas-powered engine, (2) implement a first time delay and after said first time delay enable said engine speed selector, and (3) implement a second time delay and after said second time delay send an engage clutch signal to said clutch.

9. The modified air conditioning system according to claim 8, further including;

said gas-powered engine having a range of operating speeds;

said engine speed selector including a selected value of electrical resistance; and, said engine speed selector is configured to cause said gas-powered engine to operate at a selected operating speed within said range of operating speeds.

10. The modified air conditioning system according to claim 8, further including:

said engine speed selector including a DIP switch which contains a plurality of selectable electrical resistors.

11. The modified air conditioning system according to claim 8, further including:

a refrigerant valve which is configured to connect to said refrigerant line of said air conditioning system; and, said refrigerant valve is positionable to allow (1) said refrigerant to pass through said compressor, or (2) said refrigerant to pass through said electric compressor.

12. The modified air conditioning system according to claim 8, further including:

said air conditioning system having a return air duct containing air having a humidity, and a fan which has a plurality of operating speeds;

a humidity sensor which is positionable in said return air duct of said air conditioning system;

said humidity sensor is configured to measure the humidity of the air in said return air duct and send that humidity measurement to said controller; and, if the humidity of the air in said return air duct exceeds a predetermined value, said controller is configured to send said fan a reduce operating speed signal.

13. The modified air conditioning system according to claim 8, further including:

a refrigerant valve which is configured to connect to the refrigerant line of said air conditioning system;

a housing, and, said compressor, said gas-powered engine, said refrigerant valve, and said engine speed selector all disposed in said housing.

14. A replacement compressor assembly for an air conditioning system, the air conditioning system having an electric compressor and a refrigerant line which contains a refrigerant, the air conditioning system is configured to provide a call for cooling signal; the replacement compressor assembly comprising:

a gas-powered engine;

a compressor which is connected to said gas-powered engine, said compressor is configured to connect to the refrigerant line of the air conditioning system so that the refrigerant passes through said compressor;

a controller which is configured to receive the call for cooling signal from the air conditioning system and send a start engine signal to said gas-powered engine;

a refrigerant valve which is configured to connect to the refrigerant line of the air conditioning system;

said gas-powered engine including a tachometer which is configured to send a tachometer signal to said controller when said gas-powered engine is operating; and, if said tachometer signal is not sent to said controller within a period of time after said start engine signal, said controller is configured to send a switch to electric compressor signal to said refrigerant valve which causes said refrigerant valve to change positions and the refrigerant to pass though the electric compressor.

15. A modified air conditioning system, comprising:

an air conditioning system having an electric compressor and a refrigerant line which contains a refrigerant;

a gas-powered engine;

a compressor which is connected to said gas-powered engine, said compressor is configured to connect to said refrigerant line of said air conditioning system so that said refrigerant passes through said compressor;

said air conditioning system is configured to provide a call for cooling signal; and, a controller which is configured to receive said call for cooling signal from said air conditioning system and send a start engine signal to said gas-powered engine;

said gas-powered engine including a tachometer which is configured to send a tachometer signal to said controller when said gas-powered engine is operating;

if said tachometer signal is not sent to said controller within a period of time after said start engine signal, said controller is configured to send a switch to electric compressor signal to said refrigerant valve which causes said refrigerant valve to change positions and said refrigerant to pass though said electric compressor.

* * * * *